United States Patent [19]

Ressler

[11] 4,087,132

[45] May 2, 1978

[54] DEVICE FOR GUYING A MOVABLE CUTTING MACHINE

[75] Inventor: Friedrich Ressler, Fohnsdorf, Austria

[73] Assignee: Vereinigte Osterreichische Eisen- und Stahlwerke-Alpine Montan Aktiengesellschaft, Vienna, Austria

[21] Appl. No.: 733,405

[22] Filed: Oct. 18, 1976

[30] Foreign Application Priority Data

Oct. 29, 1975 Austria ..... 8239/75

[51] Int. Cl.[2] ..... E21C 29/02; E21C 29/04

[52] U.S. Cl. ..... 299/33; 61/45 C

[58] Field of Search ..... 299/48, 47, 31, 33; 173/31, 32, 36; 175/118

[56] References Cited

U.S. PATENT DOCUMENTS

| | | | |
|---|---|---|---|
| 1,183,102 | 5/1916 | Morgan | 299/33 X |
| 1,729,781 | 10/1929 | Holmes | 299/48 |

FOREIGN PATENT DOCUMENTS

| | | | |
|---|---|---|---|
| 110,185 | 10/1917 | United Kingdom | 299/48 |
| 1,391,365 | 4/1975 | United Kingdom | 299/31 |

*Primary Examiner*—Ernest R. Purser
*Assistant Examiner*—William F. Pate, III
*Attorney, Agent, or Firm*—Cushman, Darby & Cushman

[57] ABSTRACT

Device for guying a movable cutting machine, particularly a cutting machine provided with a caterpillar drive, in its operating position, and for moving this cutting machine in an ascending gallery being consolidated by means of supporting frames formed of caps and props or posts, characterized in that on the frame of a cutting machine there is provided at least one connecting member for at least one tension member formed of a chain or of a cable and in that the tension member is adapted to be, with interposition of a winch, connected to at least one further connecting member arranged on the cap of at least one supporting frame and releasably connected to said cap.

15 Claims, 4 Drawing Figures

DEVICE FOR GUYING A MOVABLE CUTTING MACHINE

Movable cutting machines frequently must be operated on an ascending gallery. Notwithstanding of cutting machines being usually equipped with a caterpillar drive the cutting machines are, in view of the inclination of the gallery, only operable to a limited extent. This limit exists because the caterpillar drive must be in the position to climb the ascending floor of the gallery and because the cutting head must be forced against the face and the counterforce must be applied by the chassis of the cutting machine. It is known to equip cutting machines with props which are adapted to guy the cutting machine between the mine floor and the mine roof, what, however, requires a special construction of the cutting machine but does not make the cutting machine capable of climbing steep galleries which cannot be climbed by the caterpillar drive of the cutting machine alone.

The invention aims at making usable movable cutting machines even on steeply ascending galleries and provides a device for guying a movable cutting machine, particularly a cutting machine provided with a caterpillar drive, in its operating position, and for moving this cutting machine in an ascending gallery being consolidated by means of supporting frames formed of caps and props or posts. The invention essentially consists in that on the frame of the cutting machine there is provided at least one connecting member for at least one tension member formed of a chain or of a cable and in that the tension member is adapted to be, with interposition of a winch, connected to at least one further connecting member arranged on the cap of at least one supporting frame and releasably connected to said cap. In this manner, cutting machines of usual construction can be moved by means of their chassis and by means of the winch even on the steepest galleries and can be kept in operating position. According to the invention, the connecting member arranged on the cap conventiently is additionally supported against caps and, respectively, or props and posts arranged in other sections of the gallery so that the total force is not acting on only one supporting frame. In this case and in correspondence with a preferred embodiment of the invention, the connecting member arranged on a cap is supported against both sidewalls of the gallery, particularly against props or posts provided at the side walls of the gallery, by means of diverging bars extending in a direction opposite to the direction of face advancement and including an acute angle with both, the roof of the gallery and the sidewalls of the gallery. For better distributing the acting force, a plurality of posts or props arranged at the sidewall of the gallery are connected in direction of the gallery by means of a tie-beam against which the bars are supported. In this case, the bars conveniently are extensible in a telescopic manner, noting that the telescopic parts are formed of the piston and of the cylinder of a hydraulic means, so that these bars can exert the required force. In this case, the winch is conveniently arranged on the connecting member in its turn being arranged on the cap. In this manner, the acting force is, via the diverging bars, directly distributed to a plurality of supporting frames.

According to a preferred embodiment of the invention, the arrangement is such that the connecting member arranged on the cap is formed of a slide engaging at least two caps and being slidable relative to a guideway extending in direction of the gallery over more than two caps and being adapted to be suspended on caps. The cutting machine is in dependence on the progress of face advancement advanced by means of the winch and of the caterpillar drive. After a certain path of advancement, the point of attack of the tension member must, as a consequence, also be advanced to a more advanced supporting frame and this is greatly facilitated that the slide comprising the point of attack is being advanced on the guideway. According to the invention, the guideway can be formed of a rod or tube and the slide can be formed of a part having the shape of a bushing nd embracing the rod or tube. According to the invention, the slide forming the connecting member arranged on the cap is suspended to the cap with interposition of the guideway having its ends suspended to caps. If the point of attack of the tension member is to be advanced to a cap located in more advanced position, it is only necessary to loosen the guideway at the points of suspension on the caps, to advance the guideway, noting that on forward movement of the guideway the connecting member formed of the slide remains in engagement on the cap, and to suspend the guideway in the desired position on more advanced caps, whereupon, after loosening the diverging bars, also the connecting member formed of the slide can be advanced in the new desired position along the guideway. Conveniently and according to the invention, at least one connecting point for the idle strand of the tension member is provided at the rearward portion, as seen in direction of face advancement, of the guideway. This allows, on the one hand, to suspend the idle strand of the tension member such that it does not represent any hindrance for the work and allows, on the other hand, to shift the guideway in forward direction by means of the idle strand of the tension member being suspended to the connecting point when merely operating the winch in the opposite sense of rotation.

It is furthermore convenient to provide on the rearward end of the slide, as seen in direction of face advancement, a roller for the idle strand of the tension member and to provide on the forward end of the guideway, as seen in direction of face advancement, for the slide a connecting point for the idle strand of the tension member. This arrangement allows the idle strand of the tension member to be returned by the roller and to pull the slide in direction of face advancement by means of said idle strand being connected to the forward end of the guideway.

According to the invention, conveniently at least one connecting member for a tension member is provided at the rearward end of the cutting machine, so that a relatively long path of advancement for the cutting machine is obtained without changing the position of the connecting member arranged on the cap. In case only one connecting member being provided at the rearward end of the cutting machine, this connecting member conveniently is arranged in a central position.

Up to a certain angle of inclination of the gallery, a cutting machine can reliably be kept in position by means of its caterpillar drive as long as the cutting machine is not loaded by the force of reaction of the operated cutting head. If, however, such an angle of inclination of the gallery is exceeded, the cutting machine is required to be supported while moving the connecting member to be arranged on a cap from one cap to another cap. For this purpose and in accordance with the invention, on both sides of the frame of the cutting machine and adjacent the floor of the gallery, hydraulically operable and telescopic rods can be pivotally connected, by means of which the cutting machine can be supported, for example be supported against the tie-beams arranged at the areas of transition between the sidewalls of the gallery and the floor of the gallery. Up to a certain angle of inclination of the gallery, the caterpillar drive of the cutting machine is sufficient for advancing the cutting machine. The winch may be additionally made use of.

The invention is further illustrated with reference to the drawing showing an embodiment of a device according to the invention.

In the drawing

Figure 1:
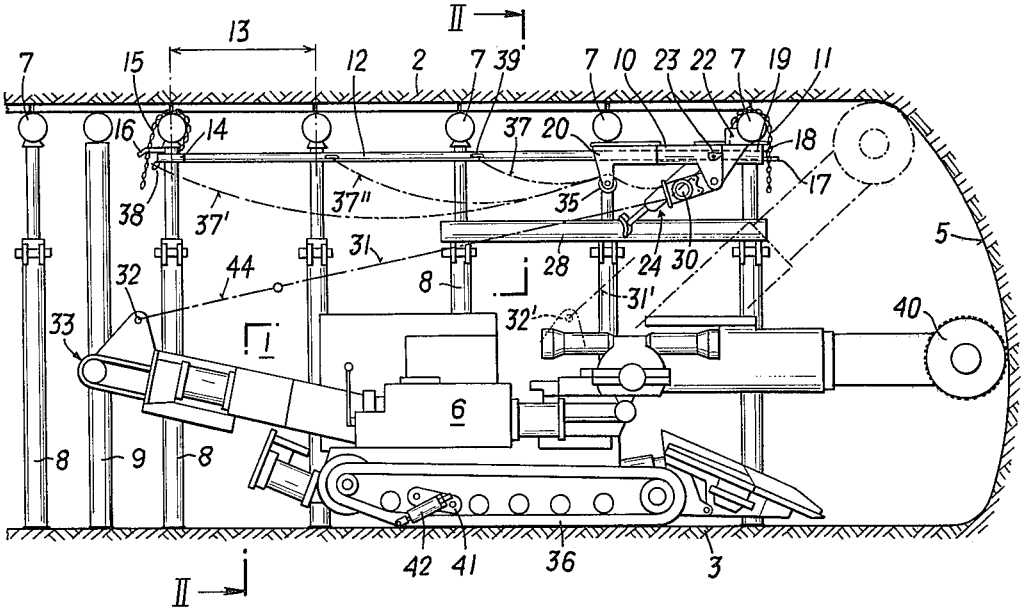
FIG. 1 represents a vertical longitudinal section through the gallery.
Figure 2:
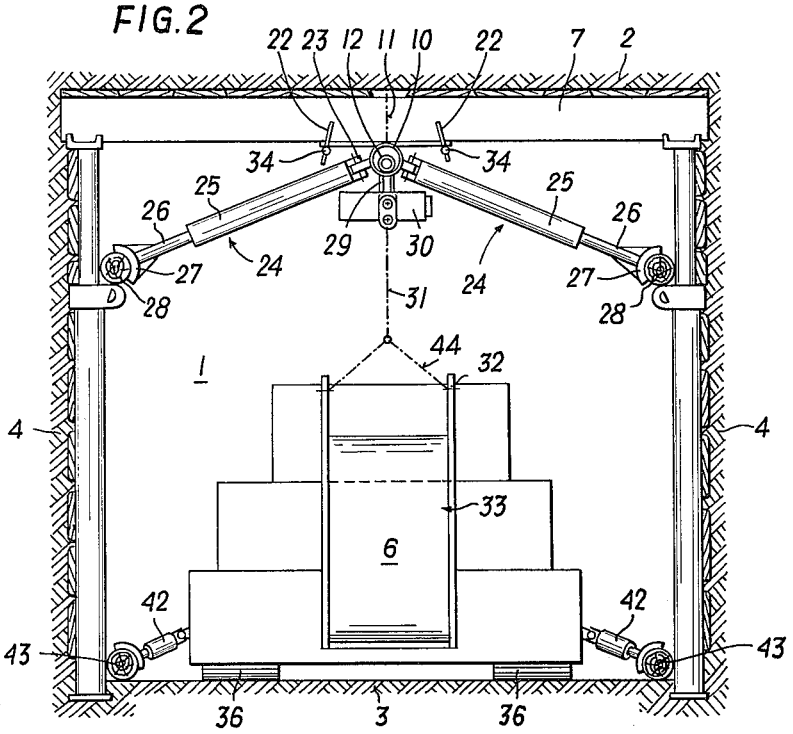
FIG. 2 is a cross-section along line II—II of FIG. 1 and showing only the contour of a cutting machine.
Figure 3:
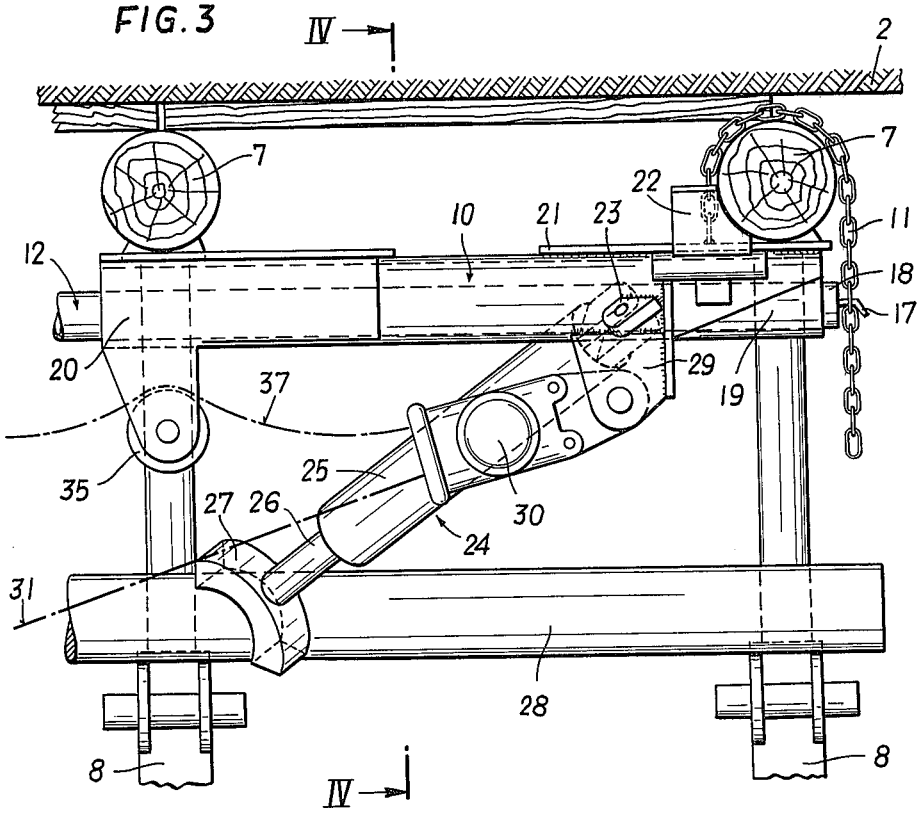
FIGS. 3 and 4 show the arrangement of the supporting means and of the advancing means at a cap as is shown in FIGS. 1 and 2 but in an enlarged scale.
Figure 4:
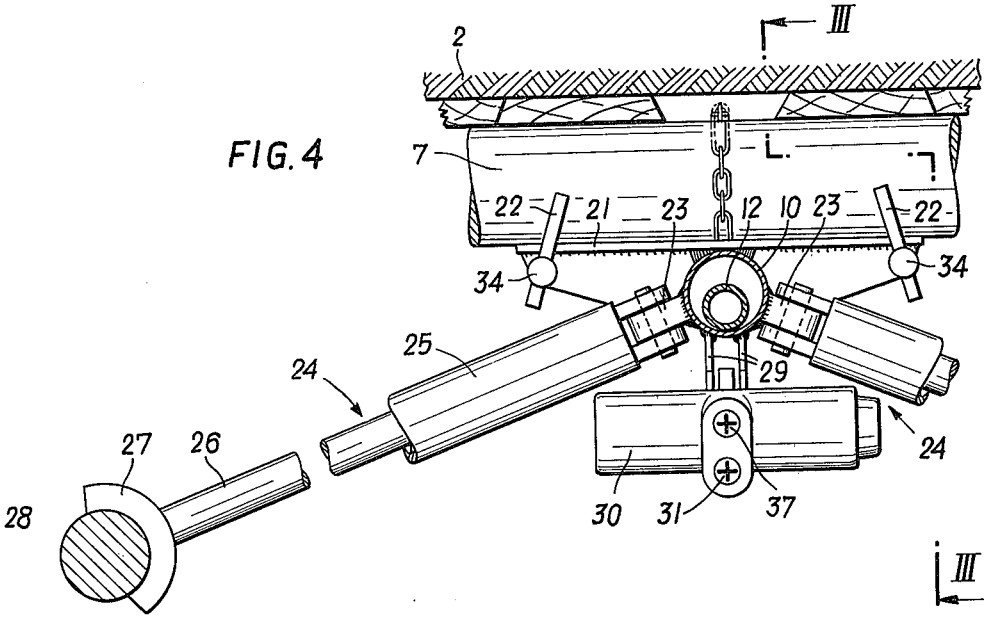

The roof of the gallery 1 is designated 2 and the floor of the gallery is designated 3. The sidewalls of the gallery are designated 4 while the face is designated 5. 6 is the cutting machine. The gallery 1 is consolidated by means of supporting frames consisting of caps 7 and props or posts 8. The props or posts 8 consist of steel and can be extended in telescopic manner. Behind the cutting machine, wooden posts 9 are additionally arranged in the interstices between the posts or props 8.

The right hand end 19 of the slide 10 is supported on the cap 7 of the supporting frame 7,8 located the nearest to the mine face 5. This slide 10 is with its left hand end 20 also engaging the immediately following cap 7. The slide has the shape of a bushing and is guided on a tube 12 which extends over a plurality of spacings 13 between adjacent supporting frames and which is, by means of a chain 15, suspended to the left hand end 14 of cap 7. The chain 15 is wound around the cap 7 and hung to a hook 16 provided at the left hand end 14 of the tube 12. The right hand end 18 of the tube 12 protrudes from the slide 10 and is provided with a hook 17 to which is supended a chain 11 wound around a cap 7. The tube 12 is thus suspended to the caps and forming a guideway on which the slide 10 can be reciprocated.

A supporting plate 21 is fixed to the right hand end of the slide 10. This supporting plate 21 comprises two pivotable claws 22 which can be swivelled around axes 34. The slide 10 is supported against the cap 7 by means of said supporting plate 21 and of said claws 22. Telescopic bars 24 formed of a hydraulic cylinder 25 and a piston 26 are pivotally connected to two laterally protruding and downwardly inclined eyes 23. The pistons 26 comprise shoes 27 which rest on tie-bars 28 being supported against the posts or props 8. These tie-bars 28 extend over a plurality of props or posts (in the embodiment shown over three posts or props) to which these tie-bars may be fixed by means of chains. By means of said hydraulic bars 24, the slide 10 is pressed against both caps 7. Furthermore, two downwardly directed eyes 29 are fixed on the right hand end of the slide and a hydraulically or pneumatically operated winch 30 is pivotally connected to said eyes 29. The winch used is a winch as is usually used in mines. This winch 30 acts on a tension member 31 formed of a chain, the other end of which is connected to a connecting member 44 provided at the rearward end 33 of the cutting machine. This connecting member 44 is formed of a chain connecting two lugs 32 and being acted upon by the tension member 31 at its middle *m* portion. The force applied by the tension member 31 is thus directed in longitudinal direction of the gallery 1 and acting in a downwardly inclined direction. Both hydraulic bars 24 are diverging and downwardly inclined so that the force exerted by the tension member 31 is introduced into the side walls of the gallery via said bars, via said tie-beams 28 and via three supporting frames 7,8.

37 is the idle strand of the chain 31. This idle strand is fixed to the tube 12 at 39, for instance on a hook, and thus does not represent a hindrance. In the most advanced position of the cutting machine the lugs 32 assume the position 32′ shown in dashed lines, while the tension member 31 assumes the position 31′. In this position the idle strand 37′ of the chain has become longer and is then fixed at 38 to the tube 12 forming a guideway. 37″ represents the position of the idle strand 37 of the chain in an intermediate position of the cutting machine.

In dependence on progressing exploitation at the face 5, i.e. in dependence on face advancement, the cutting machine is advanced in direction to the face 5 by means of the caterpillar drive 36 and the tension force exerted by the tension member 31, noting that further supporting frames 7,8 are consecutively put in place for supporting the newly excavated part of the gallery. After a certain path of advancement, i.e. if the tension member 31 has reached the position 31′, the tension member is acting in too steep a direction for effecting further advancement of the cutting machine. In this case the tension member 31 is being relaxed while the slide 10 remains guyed by means of the bars 24. The chains 11 and 15 are than loosened. The idle strand 37 is then fixed at 38 to the tube 12, for example fixed to a hook, whereupon the tube 12 is advanced by means of the winch 30, noting that the winch 30 has to be operated in the opposite sense. The forward end 18 of the advanced tube 12 is then suspended by means of a chain 11 to the cap 7 of the foremost supporting frame 7,8, whereas the rearward end 14 of the tube 12 is suspended by means of the chain 15 to a corresponding cap 7 of another supporting frame 7,8. Subsequently, the idle strand 37 is being relaxed, put over the roller 35 provided at the rearward end of the slide 10 and fixed to the forward, now protruding end 18 of the tube 12 forming a guideway. After loosening the bars 24 and after swivelling the claws 22 around their axes 34, the slide 10 is, by pulling the idle strand 37 into the winch 30, moved in direction to the forward end 18 of the guide tube 12, noting that agin the winch 30 is operated in the opposite sense. After having advanced the slide 10, the claws 22 are again swivelled in upward direction and brought into contact with the caps 7, whereupon the slide 10 again is supported by means of the bars 24 against the tie-bars 28 which equally have been moved in forward direction. Finally, the tension member 31 is again fixed to the connecting member 44 and put under tension by means of the winch 30.

Up to a certain steepness of the gallery, the cutting machine 6, can with the tension member 31 being relaxed, be maintained in position by the caterpillar drive 36 because under this condition no operating pressure of the cutting head 40 is acting. With still steeper a gallery, the cutting machine 6 must be guyed within the gallery 1 prior to loosening the tension member 31. For this purpose, hydraulically operable, telescoping rods 42 are pivotally connected to plates 41 fixed to the frame of the cutting machine, said hydraulically operable rods 42 being adapted for being supported against tie-bars 43 engaging the props or posts 8 and being arranged at the area of transition between the sidewalls 4 of the gallery and the floor 3 of the gallery.

I claim:

1. Apparatus for guying a movable cutting machine provided with a caterpillar drive in its operating position and for moving the cutting machine in an ascending gallery having a floor, roof and sidewalls, said gallery being consolidated by means of supporting frames formed of caps and props or posts, said machine including a longitudinal frame supporting a cutting head at its forward end; said apparatus including at least one connecting member fastened to said frame near the rear end thereof; at least one tension member in the form of a chain or cable connected to said connecting member and extending forwardly, said tension member being connected via a winch to at least one further connecting member which is arranged on the cap of at least one of the supporting frames and which is releasably connected to said cap.

2. Apparatus as in claim 1 wherein said further connecting member which is arranged on the cap is additionally supported against the caps of other props or posts arranged in other sections of the gallery.

3. Apparatus as in claim 1 wherein said further connecting member which is arranged on a cap is supported against both sidewalls of the gallery and against props or posts located at said sidewalls by means of diverging bars extending in a direction opposite to the direction of advancement of the machine and including an acute angle with both said roof and said sidewalls.

4. Apparatus as in claim 3 wherein the posts or props arranged at the sidewall of the gallery are connected in the direction of the gallery by means of a tie-beam against which the diverging bars are supported.

5. Apparatus as in claim 4 wherein the diverging bars are hydraulic piston and cylinder units which are extensible in a telescopic manner.

6. Apparatus as in claim 1 wherein said at least one connecting member is provided in an axial plane with respect to the machine.

7. Apparatus as in claim 1 wherein said winch is arranged on said further connecting member which in its turn is arranged on the cap.

8. Apparatus as in claim 1 wherein said further connecting member is formed as a slide engaging at least two caps and being slidable relative to a guideway which extends in the direction of the gallery over more than two caps, said guideway being suspended on said caps.

9. Apparatus as in claim 8 wherein said guideway is suspended at its ends.

10. Apparatus as in claim 8 wherein said guideway is formed of a rod or tube and the slide is formed of a part having the shape of a bushing and embracing said rod or tube.

11. Apparatus as in claim 8 wherein the tension member includes an idle strand and wherein at least one connecting part for the idle strand is provided at the rearward portion of the guideway.

12. Apparatus as in claim 8 wherein the tension member includes an idle strand and wherein on the rearward end of the slide there is a roller for the idle strand and wherein on the rearward end of the guideway there is a connecting point for said idle strand.

13. Apparatus as in claim 1 wherein said winch is a hydraulically operated winch.

14. Apparatus as in claim 1 wherein said winch is a pneumatically operated winch.

15. Apparatus as in claim 1 wherein on both sides of the frame of the cutting machine and adjacent the floor hydraulically operable telescopic rods are pivotally connected.

* * * * *